US005109322A

United States Patent [19]

Loughlin

[11] Patent Number: 5,109,322

[45] Date of Patent: Apr. 28, 1992

[54] SAFETY BEACON

[76] Inventor: Bernard M. Loughlin, Box 385, Sayville, N.Y. 11782

[21] Appl. No.: 753,636

[22] Filed: Aug. 30, 1991

[51] Int. Cl.[5] ..... F21V 33/00

[52] U.S. Cl. ..... 362/109; 362/191; 362/253; 362/368; 362/398

[58] Field of Search ..... 362/109, 103, 119, 191, 362/253, 263, 368, 398; 182/18

[56] References Cited

U.S. PATENT DOCUMENTS

| | | | |
|---|---|---|---|
| 4,766,525 | 8/1988 | Loughlin | 362/191 X |
| 4,881,155 | 11/1989 | Gahagan | 362/191 |
| 4,941,073 | 7/1990 | Bolton | 362/119 X |

*Primary Examiner*—Stephen F. Husar
*Attorney, Agent, or Firm*—Walter G. Finch

[57] ABSTRACT

A safety beacon acting as a portable and self contained strobe light is provided for use in fire fighting and rescue operations. The purpose of the safety beacon is to enhance security and minimize the disorientation caused by darkness, smoke, or fog in a fire fighting, rescue, or underwater operation. The safety beacon is composed of a heat, chemical, water, and impact resistant casing which is joined to a lexan covered xenon strobe light. The safety beacon is activated by an insulated switch which draws power from a nine volt battery kept within an insulated housing. The safety beacon may be instantly attached to a ferrous surface by means of a magnet, suspended on a garment or other cloth substance by means of a velcro pad, and pierced into and fixed on to drywall by means of a spike attachment. A knurled wedge design allows the safety beacon to hold doors open for firefighters or to be inserted into the ground to mark position for an aerial landing.

4 Claims, 2 Drawing Sheets

SAFETY BEACON

BACKGROUND AND SUMMARY OF THE INVENTION

This invention relates to fire fighting and rescue equipment, and more particularly, to a safety beacon which functions as a strobe light for the identification of critical locations in a rescue, fire fighting, or underwater operation.

BEST KNOWN PRIOR ART

The best known prior U.S. art is as follows:

| | |
|---|---|
| 2,885,539 | 4,429,350 |
| 3,016,549 | 4,432,041 |
| 3,612,853 | 4,464,129 |
| 4,099,282 | 4,506,317 |
| 4,268,894 | 4,766,525 |
| 4,332,007 | 4,881,155 |
| 4,392,188 | |

Portable emergency lights are well known in the art. In the U.S. Pat. No. 2,885,539, McDermott discusses a portable warning lamp capable of being supported on a horizontal surface or on a tripod. The Aoki U.S. Pat. No. 3,612,853 teaches about a flashlight device primarily used in emergency situations which remains on until it is returned on to its holder.

Emergency lights capable of being used in the water are also known in art. In the U.S. Pat. No. 4,429,350, Guthrie introduces an underwater illumination device which floats on the surface and directs light downward. The Finn U.S. Pat. No. 3,016,549 teaches about a durably constructed, illuminating device designed for saving a drowning person. A similar idea incorporating a case impervious to water, a fluorescent light, and a self contained powering means is introduced by Bartunek, et al in the U.S. Pat. No. 4,268,894. The Vancheri, et al U.S. Pat. No. 4,464,129 discusses a beacon device for divers. Similarly, the Townsend U.S. Pat. No. 4,099,282 speaks about a highly visible beacon for divers as well as for rescue missions, whose strobe light is automatically set off when it is pulled from its holder.

It is often required to temporarily fix a portable illumination device to a surface or material. Illumination devices capable of being instantly fixed to a ferrous surface by means of a magnet are the subject of the Norris U.S. Pat. No. 4,392,188, The Gahagan U.S. Pat. No. 4,881,007, and the Duddy U.S. Pat. No. 4,506,317. A utility light which may be fixed to a hand bag or other article by means of velcro straps attached to its outer surface is discussed in the Gibstein, et al U.S. Pat. No. 4,332,007.

Some devices have been designed specifically for fire rescue use. The Pfisterer, et al U.S. Pat. No. 4,432,041 teached of a self contained, portable smoke penetrating light which may be used in conjunction with a smoke alarm system. In the U.S. Pat. No. 4,766,525 previously issued to Loughlin, a ladder beacon automatically activated when a ladder is put in the horizontal position and whose strobe light cuts through smoke, fog, and darkness is discussed.

Though its fierce strobe light has proven effective for fire fighters all over the country, the previously issued Loughlin patent is designed for use on a ladder and not for carrying by an individual. Though some of the previously mentioned devices have the ability to be mounted to be instantly mounted to ferrous surfaces or garments, none have the ability to do both. Also, no device thus mentioned may be readily attached to a wall in the process of hurried movement as in the case of a fire fighting or rescue situation.

OBJECTS OF THE INVENTION

It is an object of this invention to provide a safety beacon to act as a strobe light for use in fire fighting and rescue operations.

Another object of this invention is to provide a novel safety beacon whose strobe light will assist in fire fighting or rescue operations.

Still other objects of this invention are to provide a safety beacon for us in fire fighting and rescue operations which is reliable, impervious to the elements of heat, water, chemicals, and shock, and which is economical to manufacture and easy to operate.

To provide a safety beacon which may hold a door open is another object of this invention.

To provide a safety beacon which may be instantly fixed to a garment, to a ferrous surface, or to drywall is another object of this invention.

To provide a safety beacon which has a self contained powering system making it portable is another object of this invention.

And to provide a safety beacon which is activated by means of an insulated switch on its casing is yet another object of this invention.

BRIEF DESCRIPTION OF THE DRAWINGS

These and other objects and attendant advantages of this invention will become more obvious and apparent from the following detailed specification and accompanying drawings in which.

DESCRIPTION OF THE PREFERRED EMBODIMENTS OF THE INVENTION

Figure 1:
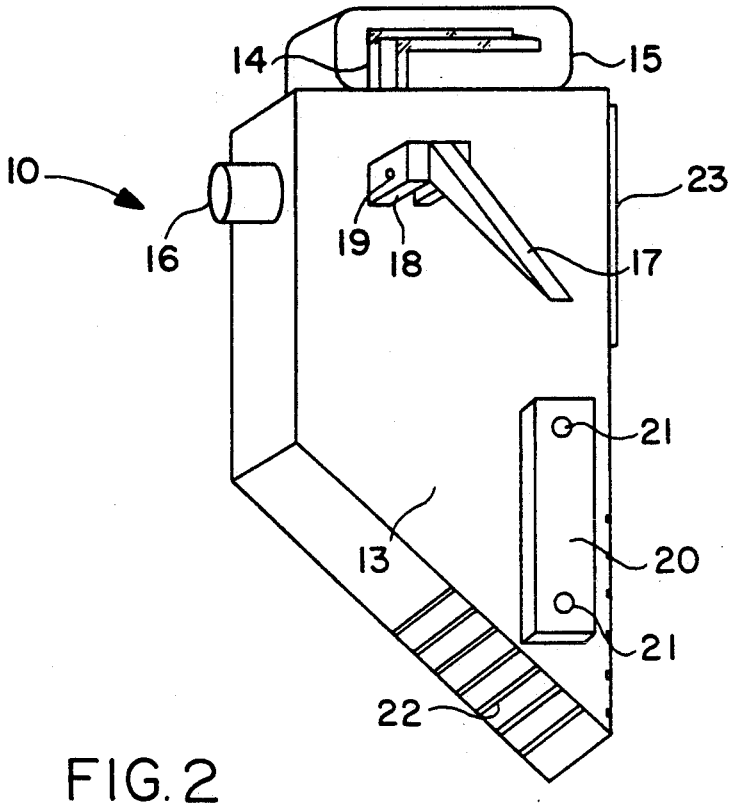
FIG. 1 is a perspective view of a safety beacon incorporating features of this invention.
Figure 2:
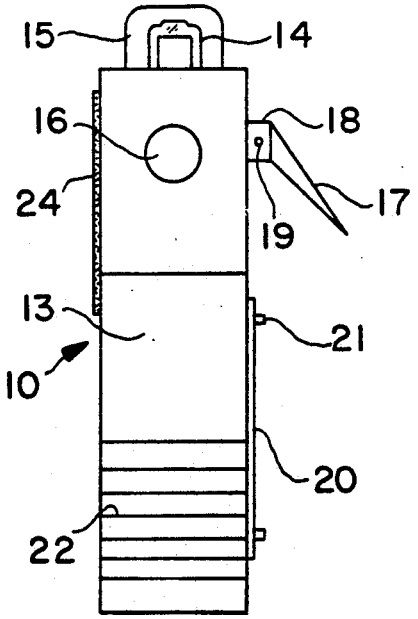
FIG. 2 is a front view of the safety beacon of FIG. 1.
Figure 3:
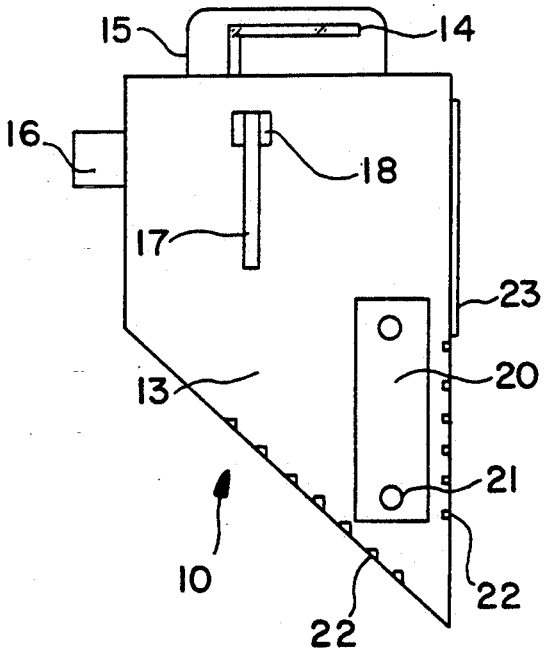
FIG. 3 is a right side view of the safety beacon of FIG. 1.
Figure 4:
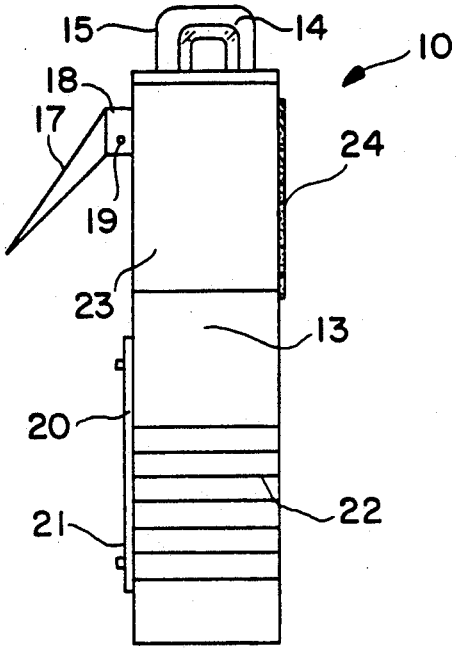
FIG. 4 is a rear side view of the safety beacon of FIG. 1.
Figure 5:
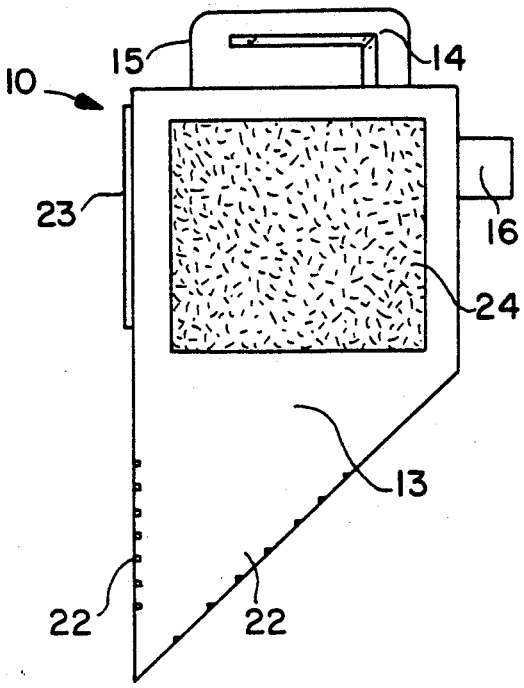
FIG. 5 is a left side view of the safety beacon of FIG. 1.
Figure 6:
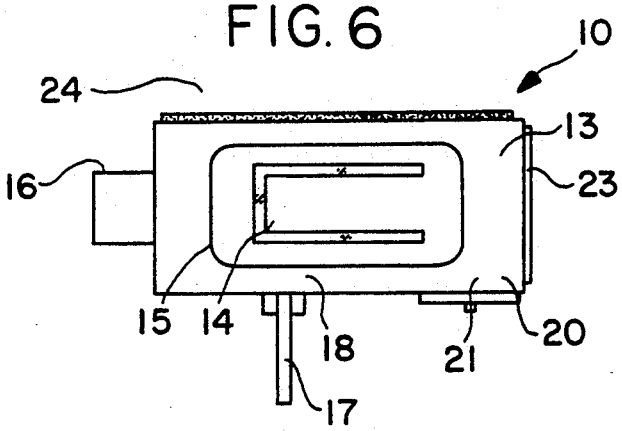
FIG. 6 is a top view of the safety beacon of FIG. 1

Referring now to FIGS. 1 to 6 of the drawings, there is shown the preferred embodiment of a safety beacon 10, a portable and self contained device used to enhance security for people in a fire fighting or rescue operation.

The safety beacon 10 consists of a shock, water, chemical, and heat resistant casing 13, a xenon strobe 14, a velcro attachment 24, a magnet attachment 23, a spike attachment 17, a battery power housing 20, an insulated power switch 16, and a knurled wedge 22.

The xenon strobe 14 is located on the top surface of the safety beacon 10, and is encompassed by a protective lexan covering 15. The xenon strobe 14 is activated by means of an insulated power switch 16. Power is supplied by a nine volt battery kept inside of an insulated battery housing 20. The battery housing 20 is tightly sealed with two screws 21.

The safety beacon uses its knurled wedge design 22 to hold doors ajar for fire fighters for insertion into soft ground for aerial landings. The safety beacon 10 is attached to a ferrous surface by means of a magnet 23, suspended on to a garment by means of a velcro pad 24, or pierced on to drywall by means of a spike 17. The spike attachment 17 is fixed between a small bracket 18 by means of a pin 19, and is free to rotate approximately ninety degrees from its most withdrawn position.

As can be readily understood from the foregoing description of the invention, the present structure can be configured in different modes to provide the ability to perform rescue, fire fighting or underwater operation in lighting.

What is claimed is:

1. A safety beacon for use as a portable strobe light in fire fighting and rescue operations, comprising, a heat resistant, water resistant, chemical resistant, and shock resistant casing, a lexan covered xenon strobe light fitted on the top of said safety beacon, a spike attachment fixed to said safety beacon capable of piercing drywall and holding said safety beacon into position, a velcro pad attached to said safety beacon used to suspend said safety beacon on to a garment or other cloth substance, a magnet joined to said safety beacon which may attach said safety beacon to an arbitrary ferrous surface, an insulated power switch which opens and closes the circuit for said strobe light on said safety beacon, an insulated battery housing which holds a nine volt battery used to power said safety beacon, and a knurled wedge on the lower portion of said safety beacon used to hold a door ajar or for insertion into soft ground.

2. A safety beacon for use as a portable strobe light in fire fighting and rescue operations as recited in claim 1, wherein said spike attachment is fixed between a bracket on said safety beacon by means of a pin, and wherein said spike attachment is free to rotate approximately ninety degrees from its most withdrawn position.

3. A safety beacon for use as a portable strobe light in fire fighting and rescue operations as recited in claim 1, wherein said insulated battery housing on said safety beacon is tightly secured by means of two screws.

4. A safety beacon for use as a portable strobe light in fire fighting and rescue operations as recited in claim 1, wherein said knurled wedge is formed on the lower portion of said safety beacon, and wherein said knurled wedge is formed on two sides of said safety beacon which meet at an acute angle, each of the two said sides having a plurality of grooves running perpendicular to the principle longitudinal axis of said safety beacon.

* * * * *